US012196513B2

(12) United States Patent
Engall et al.

(10) Patent No.: US 12,196,513 B2
(45) Date of Patent: Jan. 14, 2025

(54) FILTERED BARREL ACCESSORIES FOR MITIGATION OF ENVIRONMENTAL POLLUTANTS AND PHYSICAL HAZARDS DURING WEAPONS SYSTEMS USE

(71) Applicant: Blast Analytics and Mitigation, Inc., Encinitas, CA (US)

(72) Inventors: James Engall, Encinitas, CA (US); Tod Boretto, Encinitas, CA (US); Chris Rodewald, Encinitas, CA (US)

(73) Assignee: Blast Analytics and Mitigation, Inc., Encinitas, CA (US)

( * ) Notice: Subject to any disclaimer, the term of this patent is extended or adjusted under 35 U.S.C. 154(b) by 0 days.

(21) Appl. No.: 18/105,714

(22) Filed: Feb. 3, 2023

(65) Prior Publication Data

US 2024/0044601 A1 Feb. 8, 2024

Related U.S. Application Data

(60) Provisional application No. 63/306,457, filed on Feb. 3, 2022.

(51) Int. Cl.
*F41A 21/32* (2006.01)

(52) U.S. Cl.
CPC ..... *F41A 21/32* (2013.01)

(58) Field of Classification Search
CPC ..... F41A 21/30–38; B01D 2279/00–65
See application file for complete search history.

(56) References Cited

U.S. PATENT DOCUMENTS 1,315,504 A * 9/1919 Humm ..... F41A 21/36 89/31
2,468,926 A * 5/1949 Garrett ..... F41A 21/34 181/223
3,149,532 A * 9/1964 Pittaway ..... F41A 21/34 89/14.2
3,667,570 A 6/1972 WerBell
3,713,362 A * 1/1973 Charron ..... F41A 21/30 89/14.4
3,748,956 A * 7/1973 Hubner ..... F41A 21/30 89/14.4
4,454,798 A * 6/1984 Shea ..... F41A 21/30 181/223
4,540,417 A 9/1985 Poler
(Continued)

FOREIGN PATENT DOCUMENTS

RU 2272234 C2 * 3/2006 ..... F41A 21/30
WO WO-2015083110 A1 * 6/2015 ..... F41A 21/30

*Primary Examiner* — Gabriel J. Klein
(74) *Attorney, Agent, or Firm* — Lewis Kohn & Walker LLP; David M. Kohn

(57) ABSTRACT

Provided is a firearm filtration device that collects hazardous materials expelled by the discharge of a weapon system such as small arms, heavy weapons, and larger platform indirect and direct systems. Said weapon system may include a barrel that is either rifled or smooth bore on the internal diameter of the barrel. Said barrel terminates at the muzzle which expels a plurality of projectiles in addition to hot exhaust gases which include a wide array of hazardous materials. This device, in its various configuration, attaches or may be integrated into the muzzle end of any weapon system for the primary use of trapping and containing the hazardous components and gases expelled.

11 Claims, 18 Drawing Sheets

(56) References Cited

U.S. PATENT DOCUMENTS 4,871,495 A * 10/1989 Helferich ..... C04B 35/16 264/43
5,015,375 A * 5/1991 Fleck ..... B01D 24/08 210/450
5,136,923 A * 8/1992 Walsh, Jr. ..... F41A 21/30 89/14.4
5,152,890 A * 10/1992 Linnersten ..... B01D 29/21 55/498
5,259,853 A 11/1993 Brasier et al.
5,342,519 A * 8/1994 Friedmann ..... B01D 35/30 210/DIG. 17
5,902,182 A 5/1999 Kramer
6,298,764 B1 * 10/2001 Sherman ..... F41A 21/36 89/14.2
6,796,214 B2 * 9/2004 Hausken ..... F41A 21/30 89/14.4
7,143,680 B2 12/2006 Bender
7,237,353 B1 7/2007 Beauchamp
7,353,741 B2 4/2008 Brixius
7,530,299 B1 5/2009 Poff
7,836,809 B2 11/2010 Noveske
7,856,914 B2 12/2010 Shults et al.
8,100,224 B1 1/2012 Olson
8,196,701 B1 * 6/2012 Oliver ..... F41A 21/30 89/14.4
8,453,789 B1 6/2013 Honigmann et al.
8,516,941 B1 8/2013 Oliver
8,567,556 B2 10/2013 Dueck et al.
8,578,832 B2 11/2013 Adolphsen
8,584,794 B2 11/2013 Dueck
8,739,674 B1 * 6/2014 Huber ..... F41A 21/32 89/14.2
8,790,434 B1 7/2014 Oliver
8,794,376 B2 8/2014 Shults et al.
8,826,793 B2 9/2014 Oliver
8,844,422 B1 9/2014 Klett
8,910,745 B2 12/2014 Latka
9,115,949 B1 8/2015 Morrison
9,261,317 B2 2/2016 Daniel et al.
9,328,984 B2 5/2016 Shults et al.
9,377,263 B1 6/2016 Sy
9,546,838 B2 1/2017 Liskey et al.
9,857,137 B2 1/2018 Barrett
10,012,464 B2 7/2018 Bray
10,393,463 B1 8/2019 Sanders et al.
10,690,433 B2 6/2020 Oliver
11,059,108 B1 7/2021 Kunsky
11,255,623 B2 2/2022 Kras et al.
2004/0214518 A1 10/2004 Lanham et al.
2006/0123983 A1 6/2006 Vias
2014/0349564 A1 11/2014 Lamothe
2015/0354422 A1 * 12/2015 Liskey ..... F41A 21/30 89/14.4
2016/0003570 A1 1/2016 Tonkin
2016/0020915 A1 1/2016 Anggawijaya
2016/0123690 A1 5/2016 Larson, Jr.
2019/0277591 A1 * 9/2019 Schwartzkopf ..... F41A 21/30
2019/0285375 A1 * 9/2019 Hartwell ..... F41A 21/30
2023/0392893 A1 * 12/2023 Sjögren ..... F41A 21/30
2024/0077272 A1 * 3/2024 Lowell ..... F41A 21/36

* cited by examiner

FILTERED BARREL ACCESSORIES FOR MITIGATION OF ENVIRONMENTAL POLLUTANTS AND PHYSICAL HAZARDS DURING WEAPONS SYSTEMS USE

FIELD OF THE INVENTION

This application relates generally to mitigating environmental pollutants and physical hazards from the use of propellant based small arms and heavy weapons.

BACKGROUND OF THE INVENTION

Weapon systems, including small firearms and heavy weapons, are sources of known environmental pollutants and physical hazards when fired due to combustion of propellant-based cartridges and expulsion of a projectile from the system. Occupational health programs focus on mitigating these hazards to reduce adverse health outcomes from these systems. The hazards include acoustics, blast overpressure, gas and metallic toxin exposure, and exposure to nanosized materials from operating these weapons. Understanding how adverse outcomes, such as noise induced hearing loss, traumatic brain injury (TBI), blast-induced traumatic brain injury (bTBI), lung damage, cancer, and other detrimental health impacts from firing weapons has led to novel approaches and technologies to mitigate user exposure and decrease the environmental impacts from these weapon systems. This includes muzzle specific accessories, such as suppressors which have been co-opted to reduce impulse noise exposure, and even large-scale industrial filtration systems at indoor ranges to reduce toxic gases and metallics released into the environment from the weapons.

Firearms produce gas and metallic pollutants as a byproduct from the combustion of the primer, propellant, and the projectile being discharged from the weapon. These byproducts have unintended environmental impacts on the air, soil, and groundwater, as observed around high use facilities, such as military bases. In addition to environmental impacts, firearms are sources of hazards to humans and animals. These hazards include acoustic, blast overpressure, gases, metallic toxins, exposure to nanosized materials and other exposures that have known and unknown adverse health outcomes. The use of current barrel muzzle accessories, such as muzzle breaks and suppressors, were designed to reduce the recoil and the acoustic report while firing these weapons systems, respectively. Unfortunately, the tradeoff for a reduction of these properties leads to an increase in exposure to gases and metallic toxins for the operator due to changes in venting and internal flow characteristics within the muzzle accessory device towards the user of the firearm. The device and methods of the present invention aim to mitigate environmental and user exposure to these byproducts and involves producing a housing and corresponding filtration device for firearms and weapon systems as a barrel muzzle accessory designed to reduce environmental toxins and pollutants. The present invention is also aimed at reducing known hazards to users and bystanders in another embodiment by resolving current muzzle accessory device designs, such as muzzle breaks and suppressors, that may lead to an increase in user exposure to nanosized materials, gases, and metallic toxins by providing a filtering mechanism of gases and metallic toxins that are propelled into the muzzle accessory devices and exit the weapon system through discharge and/or backflow while firing these weapon systems, such as when muzzle breaks or suppressors are used. It is also designed, when possible, to divert remaining discharge away from the operator rather than towards the operator as is currently the case with many barrel accessories.

Muzzle accessory devices for firearms and heavy weapons are designed with specific features to optimize operation and improve functionality to the weapon or to the user. For example, muzzle breaks reduce recoil and barrel jump by diverting discharged gases at rearward and different angle, as evidenced by U.S. Pat. Nos. 7,143,680, 7,530,299, 8,578,832, 9,377,263, 7,237,353, 7,353,741 and U.S. Patent Pub. No. 2016/0123690. Another example of a muzzle accessory device is the flash suppressor. Flash suppressors were designed to reduce visible signatures of the discharge from the barrel of the firearm, and have numerous variations as evidenced by U.S. Pat. Nos. 7,836,809, 8,844,422, 10,012,464 and 8,794,376. In addition, refractory foams and aqueous foam has been used as a muzzle accessory to reduce muzzle flash from small and large caliber weapons, as evidenced by U.S. Pat. Nos. 4,454,798 and 6,298,764, however, none of these devices were designed to capture gases and other environmental toxins that are discharged from these weapon systems. Another example of a muzzle accessory that optimizes user operation and improves functionality is modular construction that introduces adaptor options to interchange various independent muzzle devices into one unified muzzle accessory as evidenced by U.S. Pat. Nos. 8,826,793 and 8,516,941.

Those skilled in the art understand the current state of the art of impulse suppressor designs are focused on making suppressors more efficient. An early design of suppressors, also called noise suppressor or silencer, focused on adding materials, such as steel wool to attenuate impulse noise, as evidenced by U.S. Pat. Nos. 5,136,923 and 4,540,417. More recent designs include a tubular housing with a series or plurality of baffles, as evidenced by US Patent No. U.S. Pat. No. 3,667,570. Variations in housings and baffles have also been designed, as evidenced by U.S. Pat. Nos. 9,328,984, 9,261,317, 8,453,789, 8,100,224, 7,856,914, 8,910,745, and EP Patent Pub No. 3,237,829. Materials, such as sintered polymer, with porous features have also been used as a substitute to traditional suppressor housing and baffle designs to allow overpressure and acoustic properties to dissipate through a larger surface area as evidenced by U.S. Pat. No. 9,546,838. Another characteristic that has been added to suppressors are combustible gas flow baffle designs as evidenced by U.S. Pat. Nos. 10,690,433 and 11,255,623. Additional characteristics, such as a blast deflector have also been designed as evidenced by U.S. Pat. No. 8,584,794. One relevant design feature to the housing is the advent of an inner sleeve to allow for insertion and removal of parts for cleaning and replacement as evidenced by U.S. Pat. No. 8,567,556. Modular suppressor designs add configurability as evidenced by U.S. Pat. Nos. 8,826,793, 9,115,949, and US Patent Pub. No. 2016/020915, an integral suppressor can be contiguous with barrels as evidenced by US Patent Pub. No. 2016/0003570 and 2015/0090105. Recently, additional designs related to solvent traps have been invented as evidenced by U.S. Pat. No. 11,059,108. Another relevant suppressor design incorporates high-energy materials in the dampening chamber to reduce acoustics and heat to improve optics above the firearm as evidenced by U.S. Pat. No. 8,196,701. Furthermore, self-sealing gels have been incorporated to suppress sound, as a flash hider, and to trap heavy particulates as evidenced in U.S. Pat. Nos. 10,690,433 and 8,790,434, but again none of these innovations address the serious concerns of environmental and human exposure to the harmful byproducts of the exhaust produced by these weapon systems.

Filtering firearm byproducts have largely focused on lead exposure. Designs for enclosures for shooters have focused on airflow and air exchange systems to move lead away from the shooter location as evidenced by US Patent Pub. No. 2014/0349564 and U.S. Pat. No. 5,902,182. Disposable HEPA filtration devices for lead capture have been used for lead management as evidenced by U.S. Pat. No. 5,259,854.

While these systems independently reduce exposures to impulse noise, blast overpressure, and environmental exposure to toxins, such as lead, a system has yet to be developed that incorporates these technologies into a unitary muzzle accessory system to trap and contain gas, metallics, and solvent byproducts from firing weapons. Therefore, the invention is a specialized muzzle accessory system that further reduces the hazards associated with firearms and firearms equipped with various muzzle accessory devices.

SUMMARY OF THE INVENTION

The present invention provides a novel approach to mitigating known hazards from exiting the weapon systems during normal firearm operation and overcomes known challenges of current suppressor systems by combining two separate technologies, 1) a housing, and 2) an internal fixed, replaceable and/or recyclable filter to capture gas, metallic, and solvent byproducts, including but not limited to carbon monoxide, ammonia, hydrogen cyanide, lead, copper, zinc, and bismuth that enter the housing and reduce their release through discharge or backflow, into a single unified system. In the preferred embodiment, the system filters discharged gases and nanosized materials, metallics, and solvents from the muzzle end of a firearm. In another embodiment, the filter can be incorporated and configured into other barrel accessories, such as muzzle breaks and flash hiders to provide gas and metallic filtration in these variations as well. In another embodiment, the system can be incorporated into an acoustic suppressor to reduce acoustic, blast overpressure, gases, metallics, and solvent toxins, from firing the cartridge or munition. In another embodiment, the filtration system can be incorporated into the firearm, barrel, weapon system attachment at the time of manufacture, for example, into an integral suppressor to reduce acoustic, blast overpressure, gases, metallics, and solvent toxins, from firing the cartridge or munition.

In a preferred embodiment, the filter material can vary in length, segment, position, and/or the composition, including but not limited to refractory foams, ceramics, thermoplastics, sand, polymers, naturally occurring substances, recycled goods, organics, inorganics, and synthetics. In an extension of this embodiment, the filter can be replaceable and interchangeable to maximize filtration efficiency. In the preferred embodiment, the filter membrane can be single stage or a plurality of stages to target one or many discharged gases, metallics, and solvents from the muzzle end of a firearm. In yet another preferred embodiment, the primary filter membrane can be embedded with other substrates to improve or add additional functions. For example, sublimation materials or materials which react with the hot gases can be included within the interstices of the foam, if desired. Materials with high heats of sublimation cool the gases. Such sublimation materials include, for example, polyvinyl alcohol, oxalic acid, sodium or potassium chloride, and the like. Materials which react with the hot muzzle discharge gases to suppress the flash include, for example, sodium carbonate, potassium carbonate, and the like.

In yet another embodiment, the porosity of the primary filter membrane may be configured to create pressure gradients. Such configurations, such as counterclockwise flow gradients, can be used to counteract and stabilize centrifugal force that form upon the interaction of features of the barrel and projectile. In an additional embodiment, pressure gradients to expel filtered gases can be lateral and forward venting for standard filtering configuration. In another embodiment, pressure gradients to expel filtered gases can be rearward for muzzle break configurations. In a yet another embodiment, pressure gradients to expel filtered gases forward in suppressor configurations. In yet a further embodiment, both passive and active means to determine the life cycle of the filter are incorporated into the housing. Lastly, in still another embodiment, a process related to disposing and recycling used filters is provided to ensure that user and environmental impacts of such contaminants are minimized.

BRIEF DESCRIPTION OF THE DRAWINGS

The novel features of the present invention are set forth herein embodied in the form of the claims of the invention. Features and advantages of the present invention may be best understood by reference to the following detailed description of the invention, setting forth illustrative embodiments and preferred features of the invention, as well as the accompanying drawings, of which:

DETAILED DESCRIPTION OF THE INVENTION

Described herein are methods, devices and systems specifically configured to aid in the mitigation of the physical and chemical exposures to individuals during the use of weapon systems with barrels. Each embodiment is designed to reduce exposure to these hazards at the source, the weapon system.

Figure 1:
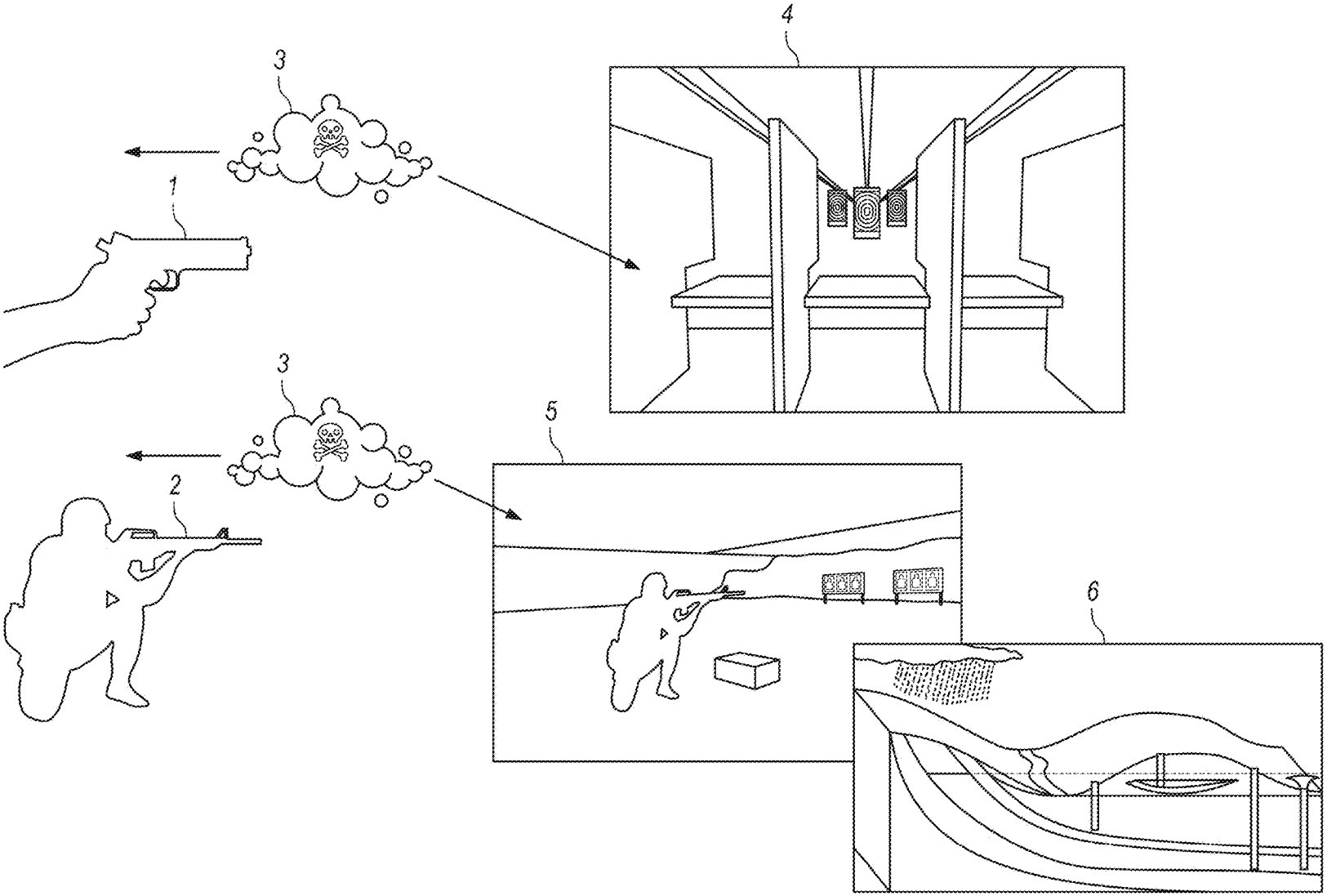
FIG. 1 is a graphical representation of the problem set demonstrating how when a firearm is discharged a wide range of hazardous contaminants are discharged into the environment and exposes the shooter and bystanders to breathing in those contaminants or through physical contact.

FIG. 1 shows a graphical representation of the hazardous byproducts created by the discharge of a firearm. Whether the firearm is a handgun 1 or a rifle/shotgun 2, both weapons produce hazardous gases 3 and lead particulates 3 when the weapon is discharged. These hazardous materials like arsenic, lead, bismuth, etc. are found in varied concentrations in and around gun ranges 4, 5. It is well known that these materials can cause serious health effects on the human body and the environment.

In the case where a firearm is discharged at an indoor firing range 4, the discharge gases 3 are collected via a high efficiency air filtration system. This type of system helps reduce the transfer of heavy metals like lead to transfer to the skin or be inhaled the shooter. Even with good air filtration, materials like lead that are very heavy particles that drop quickly to the ground and the shooters feet. If the shooting range has poor or in some cases no ventilation, the shooters are subjected to very high levels of hazardous materials like arsenic, lead, and nanosized particles.

In the case where a firearm is discharged in an open outdoor range 5, the only air movement is caused by a wind condition. The shooter 1, 2 is subjected to much higher levels of potential blowback if the wind direction is into the shooters face. Another threat caused by shooting at an outdoor range 5, is the high concentration of lead 3 that gets deposited on the ground within 15 yards down range from the shooter 1, 2. Since outdoor ranges 5 are not cleaned like indoor ranges 4, the lead deposits build up overtime. Apart from people walking on the dirt at an outdoor range 5, the biggest threat is to the groundwater 6 that lies underneath the outdoor range. When it rains, it flushes the lead particles down through the soil and into subterranean aquifers 6, thus increasing the environmental impact by contaminating the ground water.

Figure 2:
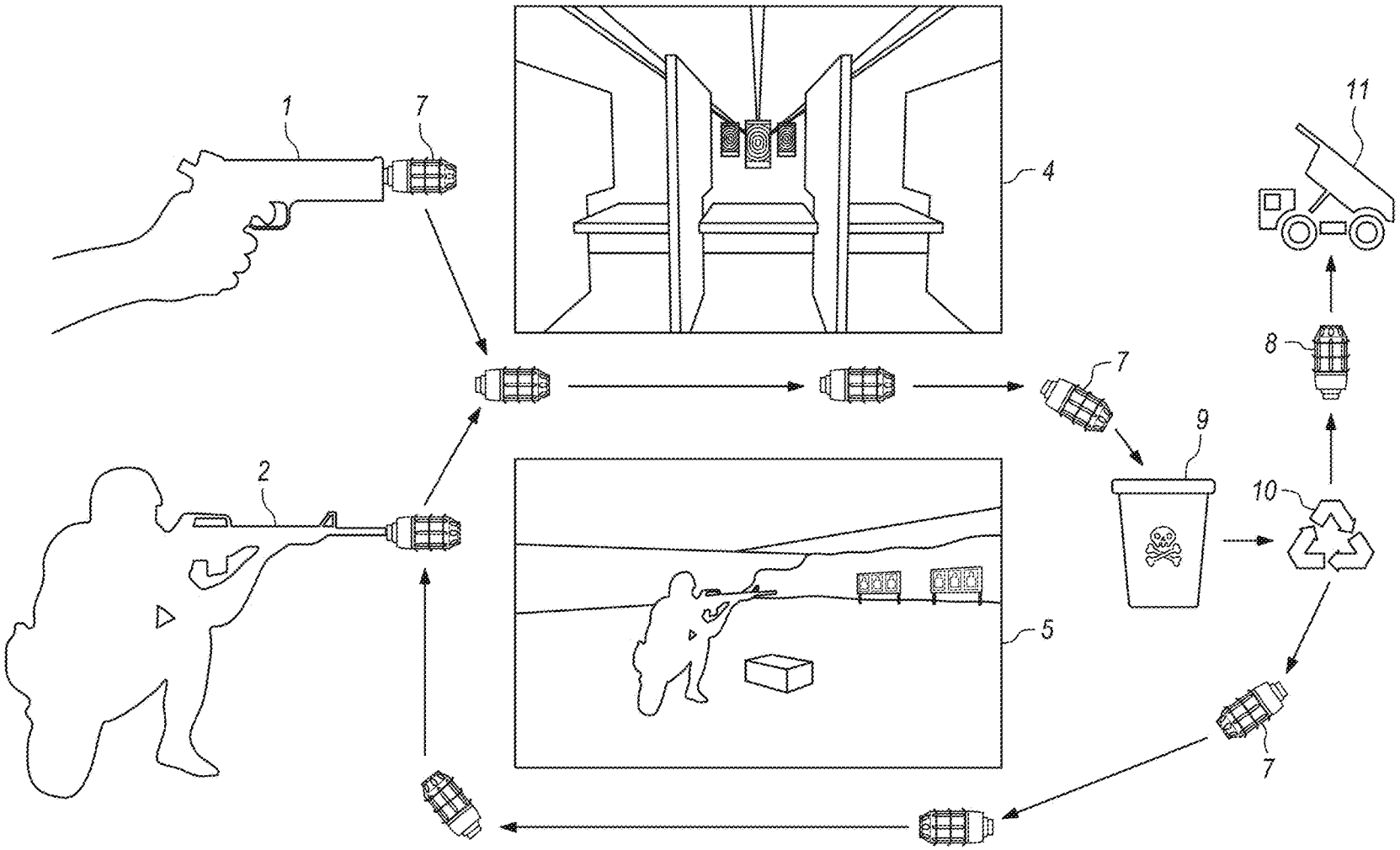
FIG. 2 is a graphical representation of the invention which depicts a novel method of capturing the hazardous contaminants that are created from the discharge of a firearm demonstrating how the device captures these contaminants at the source, at the end of the muzzle.

FIG. 2 is a graphical representation of the invention 7 and how it solves the problem presented in FIG. 1. This device 7 attaches to the muzzle end of a firearm 1, 2 and contains a unique filtering system that filters the exhaust gases caused by the weapon discharge. The concept of filtering the gases at the point of creation, reduces human exposure and environmental contamination generated at both indoor 4 and outdoor 5 ranges.

Once the device has reached its maximum saturation level, it is removed from the weapon and deposited into a special hazardous materials receptacle 9. This device has an option for a replaceable filter membrane so the housing can be reused after the membrane has been recycled 10. In another embodiment, the entire device is recycled 10 and then sent to landfill 11. This process provides for a complete capture and recyclability of hazardous materials and heavy metals like lead.

Figure 3:
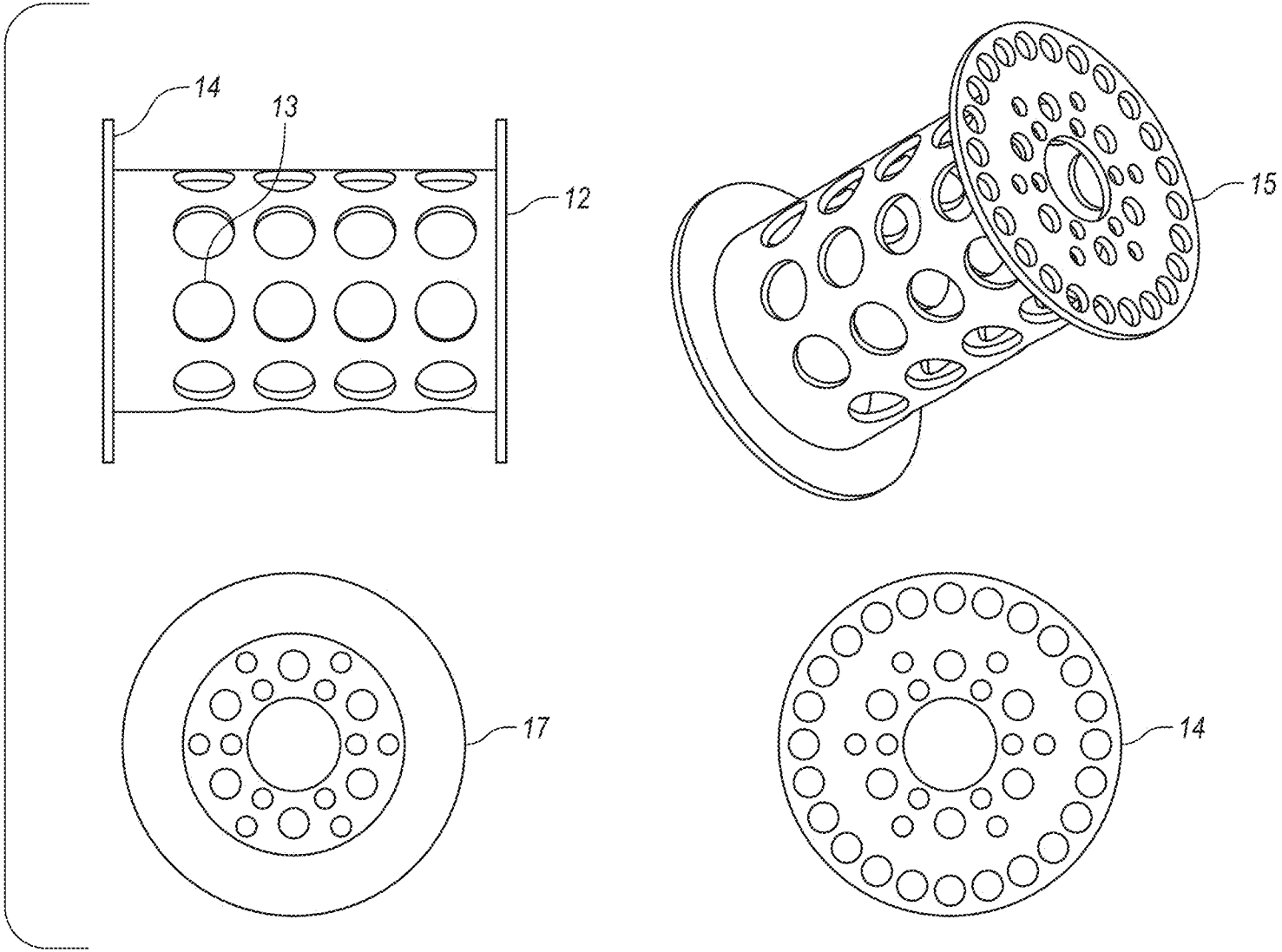
FIG. 3 shows various views of the internal filter housing that holds the filter membranes inside the device.

FIG. 3 contains a variety of views that represent the main filter membrane core housing 12. The side view 12 represents the perforated core housing. The two filter elements slip over the inner core housing holes 13 which allows the exhaust gases to enter the filter housing. This core can be referred to as a bobbin that has a removable end flange 14 that can be removed to allow the filter membrane to slide over the perforated holes of the inner core 13. Once the filter membranes are installed the flange 14 can be reattached via threads or a clamp to hold the filter in place.

The isometric view of the membrane housing details that the holes located at the exit point 15 provide for an air path through the end of the device forcing the gases forward and away from the shooter. The end view shows a configuration that maximizes the area of pass-through for the gases. The rear view represents the attachment end or muzzle end 17 of the device. It should be noted that the perimeter of the flange is solid and not perforated so that a solid seal can be made to the end of the barrel. The filter membrane housing 12 is constructed of material that can be subjected to a continuous use temperature exceeding 800 degrees F.

Figure 4:
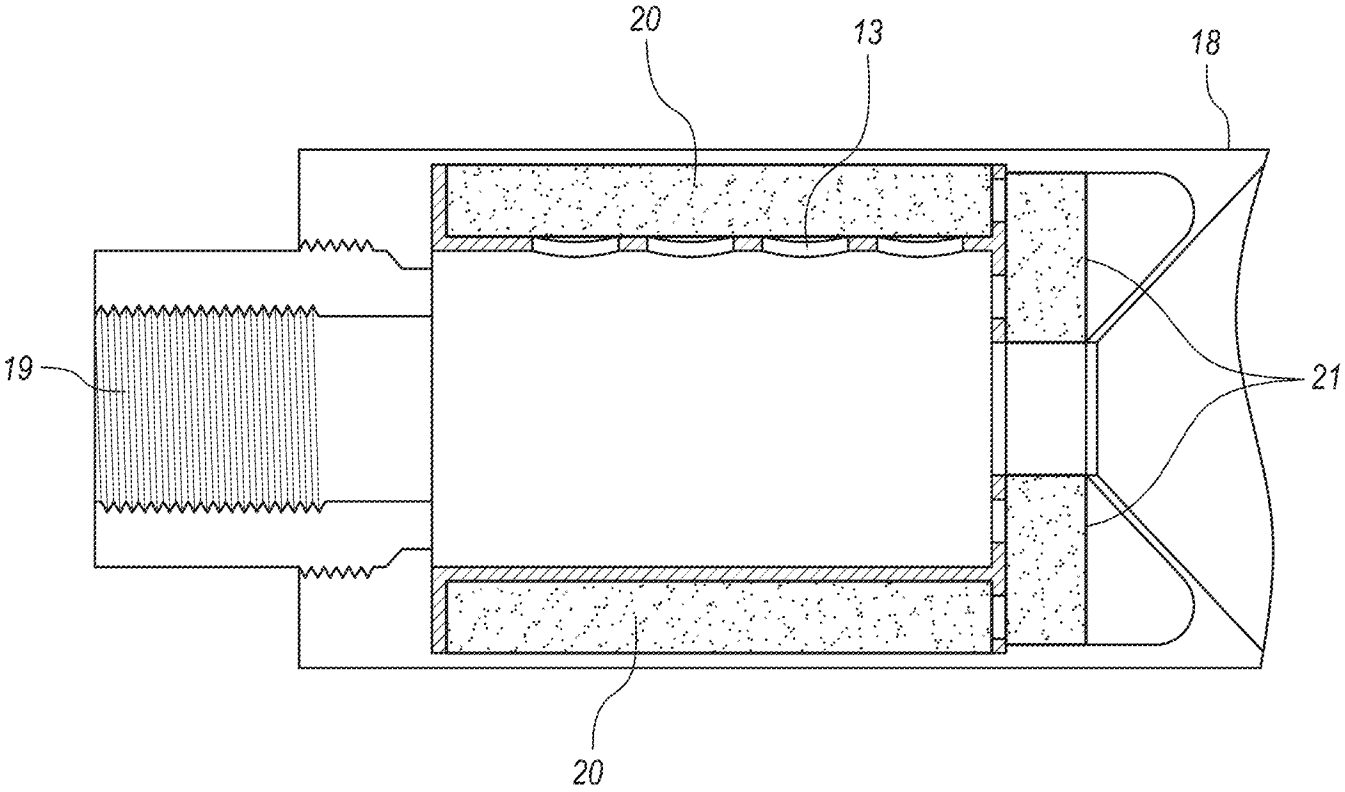
FIG. 4 is a cross-sectional side view depicting how the filter membranes are positioned inside the outer housing.

FIG. 4 is a cross-sectional side view of the filter housing 12 and how it is positioned in a typical flash suppressor 18. The filter membranes are located at both the exit point, or axial direction, of the device and in the radial direction encapsulating the membrane housing in a circumferential manner. The membrane housing 12 is fixtured within the outer housing 18 and attached via various attachment techniques (see FIGS. 13-16) to the firearm. The inner membrane housing holes 13 are designed so that the bullet passes through the device without the possibility of contacting the filter membrane 20, 21.

Figure 5:
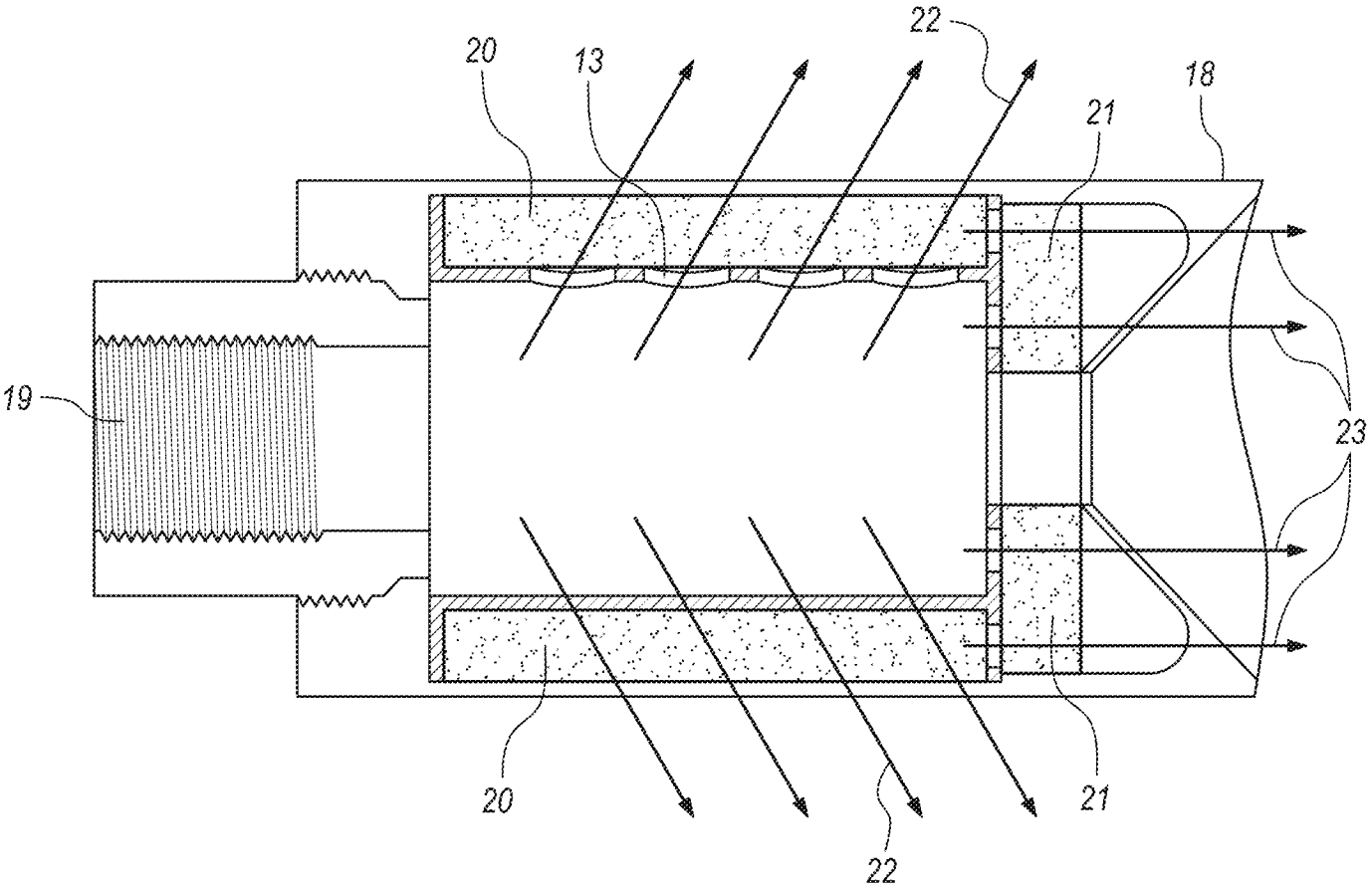
FIG. 5 is a cross-sectional side view depicting how the gases and affluent caused by the firearm discharge move through the device. All of the gases, nanosized materials, and heavy metals are forced to travel through and exit the device with a forward path, eliminating the back flow of the gases which minimizes the inhalation of harmful gases and heavy metals like lead.

FIG. 5 is a cross-sectional side view of the filter housing 18 with the filter membranes 20, 21 positioned for optimum air flow 22, 23 and the capture of heavy metals and other hazardous materials. As the firearm is discharged, the hot exhaust gases will transfer through the perforated membrane housing holes 13 and into the dual core filter membranes 20, 21. The pressure associated with the discharge of the firearm, forces the gases that contain a variety of hazardous components through the filter membrane 20, 21. The first section of the device that is subject to these gases 3, contains vents that are angled at a minimum forward facing angle of twenty degrees 22. As the gases move towards the exit 23, they are cooled and slowed due to the baffles and random hole size of the filter membrane itself 20, 21. This configuration forces all of the gases in a forward direction opposite of the shooter.

Figure 6:
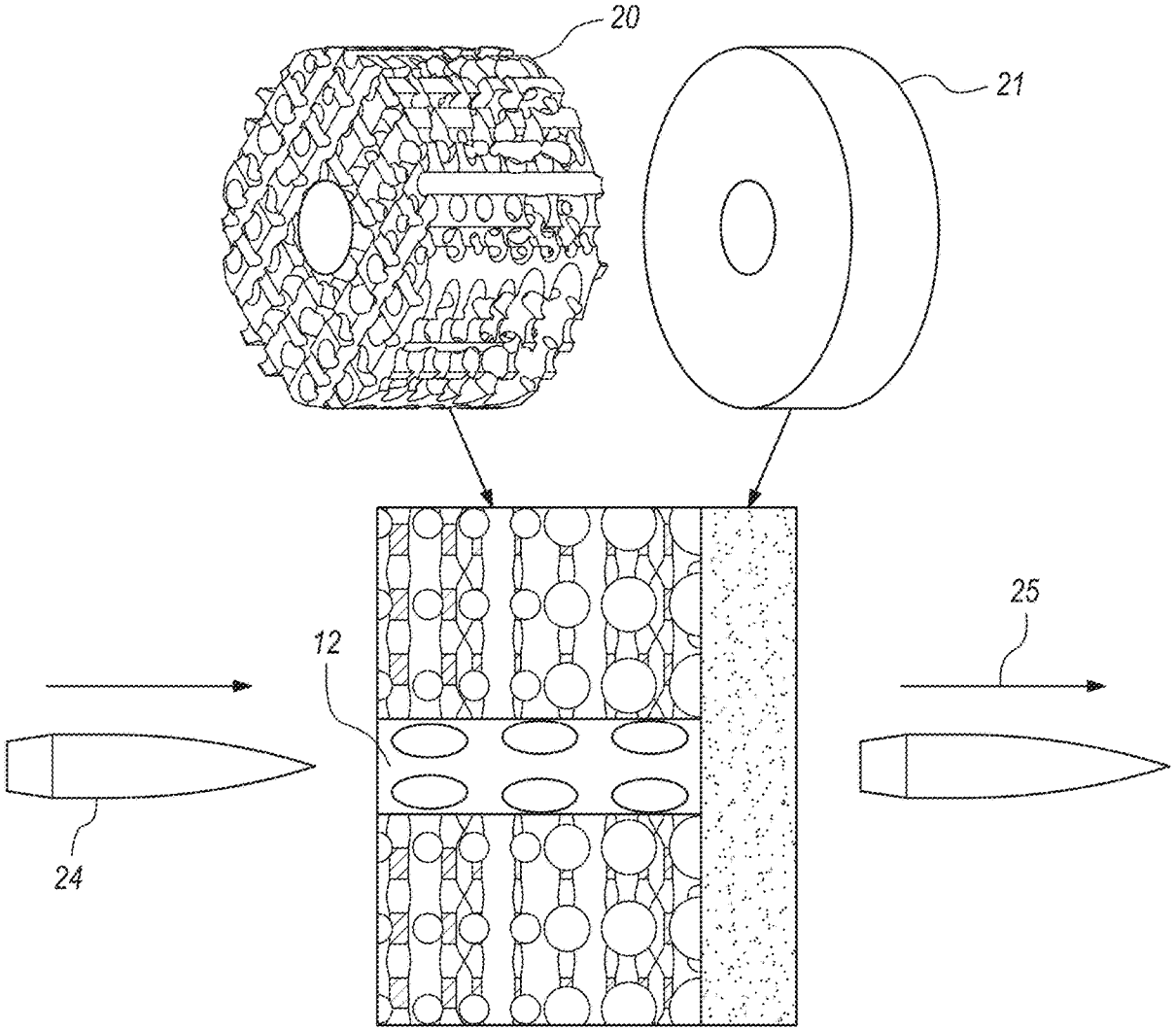
FIG. 6 is an isometric view of the two different types of filter membranes that are contained in this device. One filter type is an organic filter, and the other type is used for capturing heavy metal particles like Lead.

FIG. 6 is an isometric and cross-sectional side view of both the heavy metal filter 20 and the organic filter 21 sections. In a preferred embodiment, the filter sections 20, 21 are cylindrical in their shape but can also take on different cross-sectional profiles. The filter membrane 20 that is mostly responsible for slowing down the velocity of the gases and trapping the heavy metal particles is comprised of a refractory foam material in the preferred embodiment. Refractory foams made with ceramics and a variety of metals, can be designed to have specific size holes within the foam itself. The nature of the foams are such that they consist of holes having random sizes and orientations. This provides an excellent way of slowing the velocity of the gases and cooling the exhaust gases down. As the bullet 24 passes through the first filter section, the hot hazardous exhaust gases follow the path 25 of the bullet. These gases will pass through the heavy metal filter membrane 20 first and then travel into the organic filter section 21. The organic vapor filter 21 will filter the hazardous organic components like arsenic, cyanides, nanosized materials etc. from the discharge.

Figure 7:
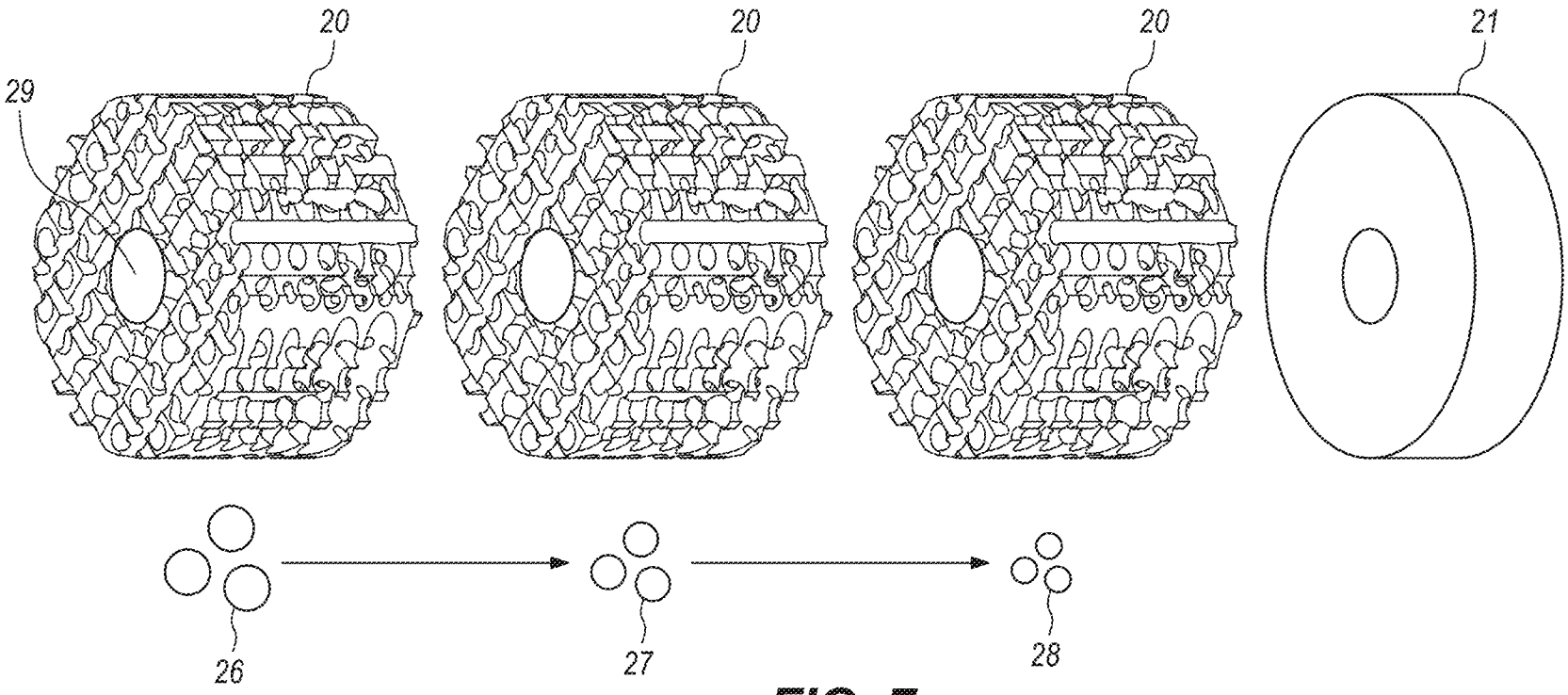
FIG. 7 is an isometric view that shows a multi-stack filter membrane with an organic filter located at the exit point of the muzzle of the firearm.

FIG. 7 is an isometric view depicting that the filter membranes 20, 21 and the organic filter 21 can be combined in sections to form various device 7 lengths. These filter sections 20, 21 can be designed to have a minimum and maximum size holes 26, 27, 28 contained within each section.

A preferred embodiment contains filter membrane sections 20 that are configured within the device 7 so that the largest cell size filter membrane section 20 is located nearest to the muzzle exit 29. The size of the holes will gradually be reduced moving towards the exit point of the device 7. Depending on how many filter sections are added, the cell size 26, 27, 28 will be reduced so that the back pressure is gradually reduced as the gases move freer at the exit muzzle 29. In this drawing, it depicts a single organic filter element 21 located at the end of the filter housing. Items 26, 27, 28 depict a reduction in refractory cell foam size within each section of the filter membrane.

The heavy metals like lead and bismuth are contained in the exhaust gases 3 (not shown) and as they travel through the refractory foam heavy metal filter membrane 20, they are trapped within the membrane due to their heavy density and are slowed down by the device 7 so they can deposit within the membrane and not get exhausted into the environment.

Figure 8:
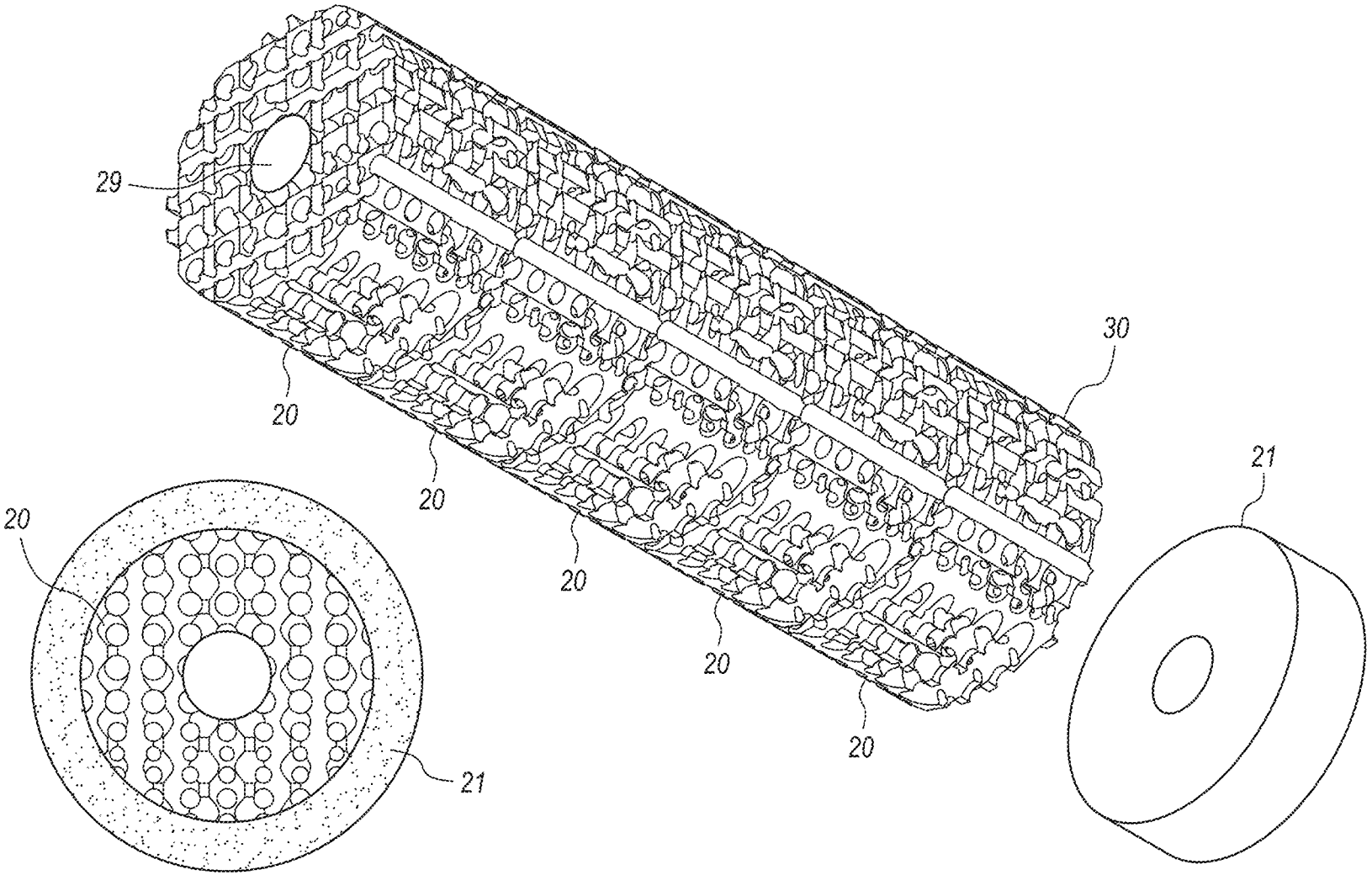
FIG. 8 depicts both an isometric view and an end view of the multistage filter assembly. This drawing also depicts placement of the organic and inorganic filter membranes in two locations at the end of the muzzle and in the radial direction in the body of the device.

FIG. 8 is an isometric view of a multi stack five membrane 30 configuration. Each of the sections 20 can have holes of varying size 26, 27, 28 along with a variety of metal compositions. In a preferred embodiment, the use of a refractory foam is used for the heavy metal filter membrane 20, however it is conceived that a rolled filter membrane made from a metal wire mesh can also be used as an effective filter membrane.

The cross-sectional end view depicts a dual membrane core consisting of a refractory foam internal membrane 20, encapsulated with an outer organic filter membrane 21. This configuration is necessary to ensure that any exhaust gases that exit the device 7, experience a reduction in organic hazardous components 3 (not shown). This is the configuration of the preferred embodiment with respect to the filter membrane itself. The ratio of the thickness of the outer organic filter membrane 21 compared to the inner heavy metal filter membrane 20 can vary based upon the type of ammo that is being discharged and the desired lifespan of the device 7 itself.

Figure 9:
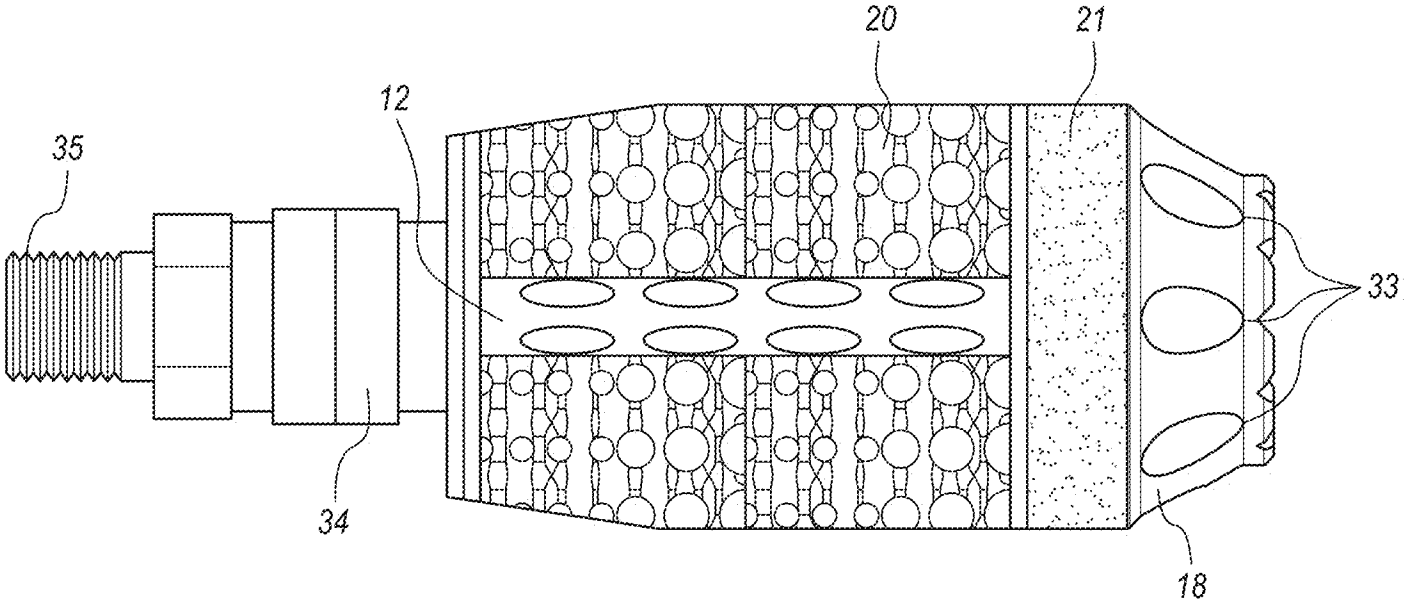
FIG. 9 is a cross-sectional side view of the preferred embodiment showing the general location of the filter membrane.

FIG. 9 is a partial cross-sectional side view of the filter housing 7 detailing how the filter elements 20, 21 are located within the exterior of the filter housing 18 at the front end of the device 7. The nose cone section consists of multiple gas exit nozzle holes 33 which allow the gases to be expelled through the nose of the device 7. This configuration shows a single heavy metal filter membrane 20 with a single organic filter 21 contained within the device 7.

The housing can be attached to the firearm barrel by using several techniques. This configuration is shown with male threads 35 which will thread into a barrel with female threads. It can also have female threads 47 (not shown) and attach to a barrel with male threads. This configuration depicts a quick disconnect coupler 34 that can be quickly attached and detached.

Figure 10:
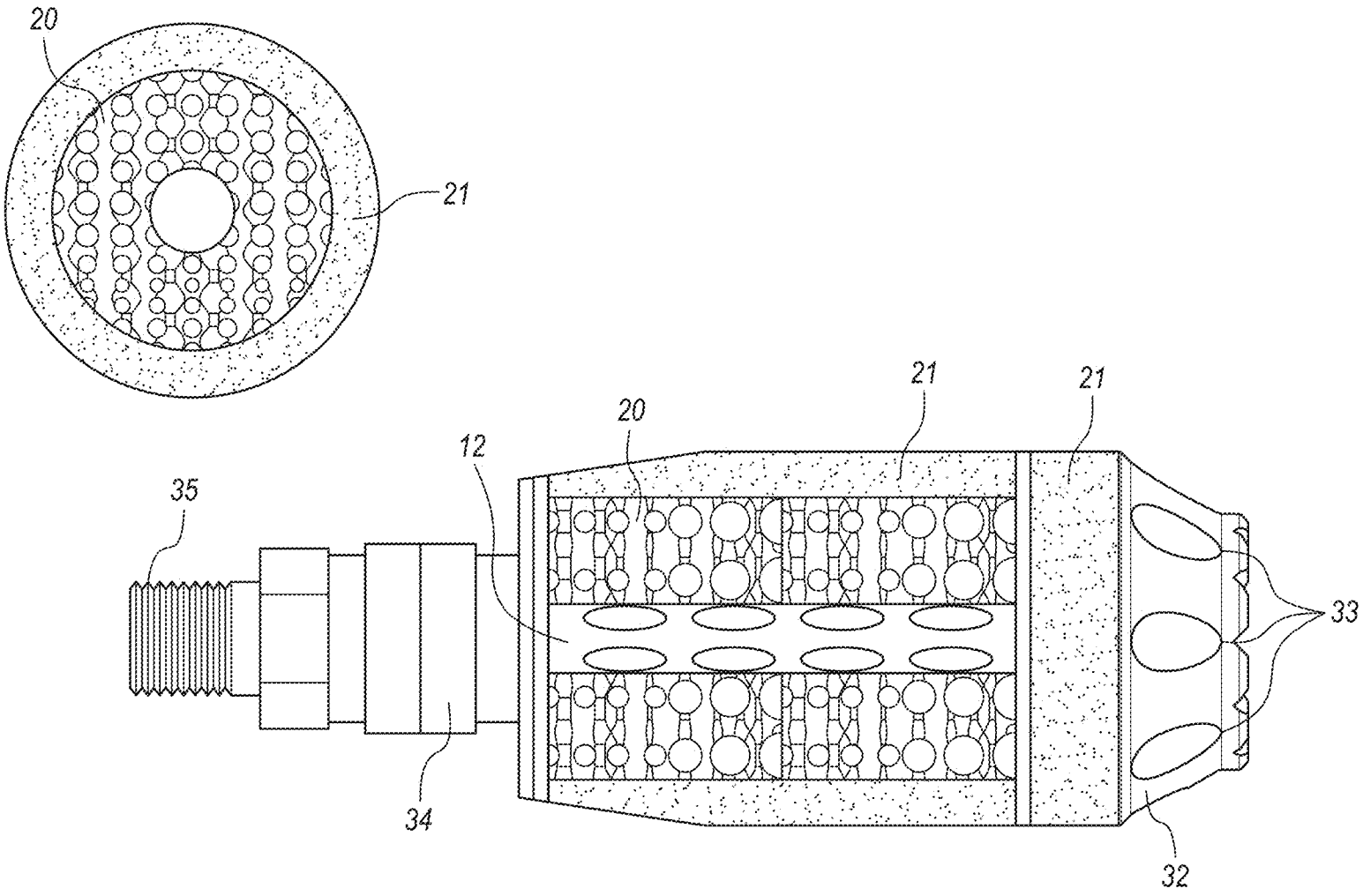
FIG. 10 is a partial cross-sectional side view and end view of the filter membrane of the preferred embodiment that contains the dual filter membrane configuration.

FIG. 10 is a partial cross-sectional side view of the filter housing 7 detailing how the filter elements 20, 21 are configured in both the radial and the axial direction within the filter housing 7. As like FIG. 9, the other drawing details are the same except that the organic filter membranes 21 are in two locations.

Figure 11:
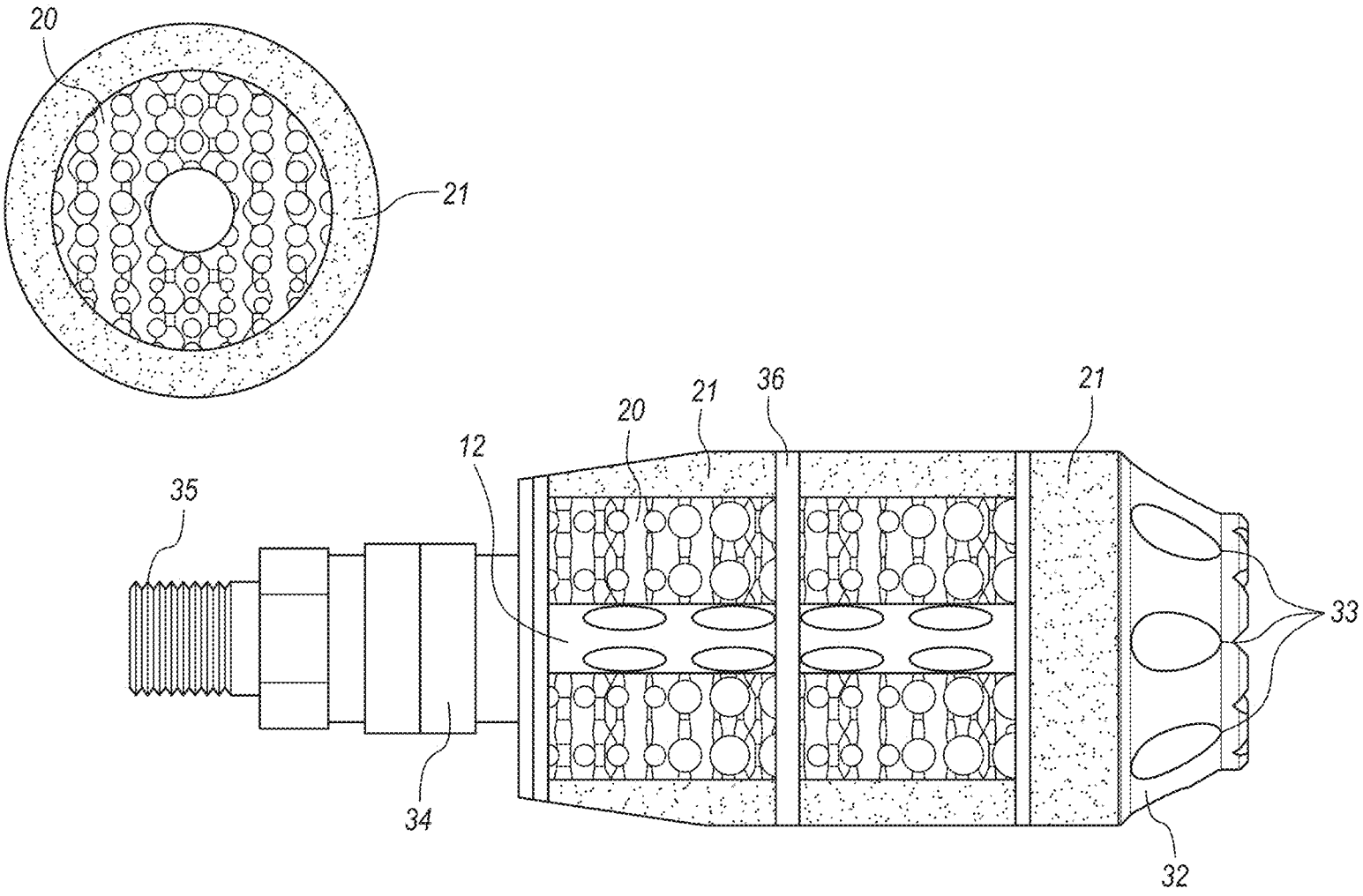
FIG. 11 is a partial cross-sectional side view and end view of the filter membrane of the preferred embodiment that contains a baffle separator(s) located within the body of the device. These baffles may be placed between multiple sections of the filter membrane.

FIG. 11 is a partial cross-sectional side view of the filter housing 7 similar to FIG. 10, except that an internal baffle 36 has been added to separate the heavy metal filter membranes 20. The internal baffle 36 can be comprised of a variety of materials and thicknesses to control pressures and air flow through the device 7. This can be used to tune the device 7 for reducing sound and directing air flow within the device 7. Multiple baffles internal 36 can be placed within the device 7 depending on the filter housing length.

Figure 12:
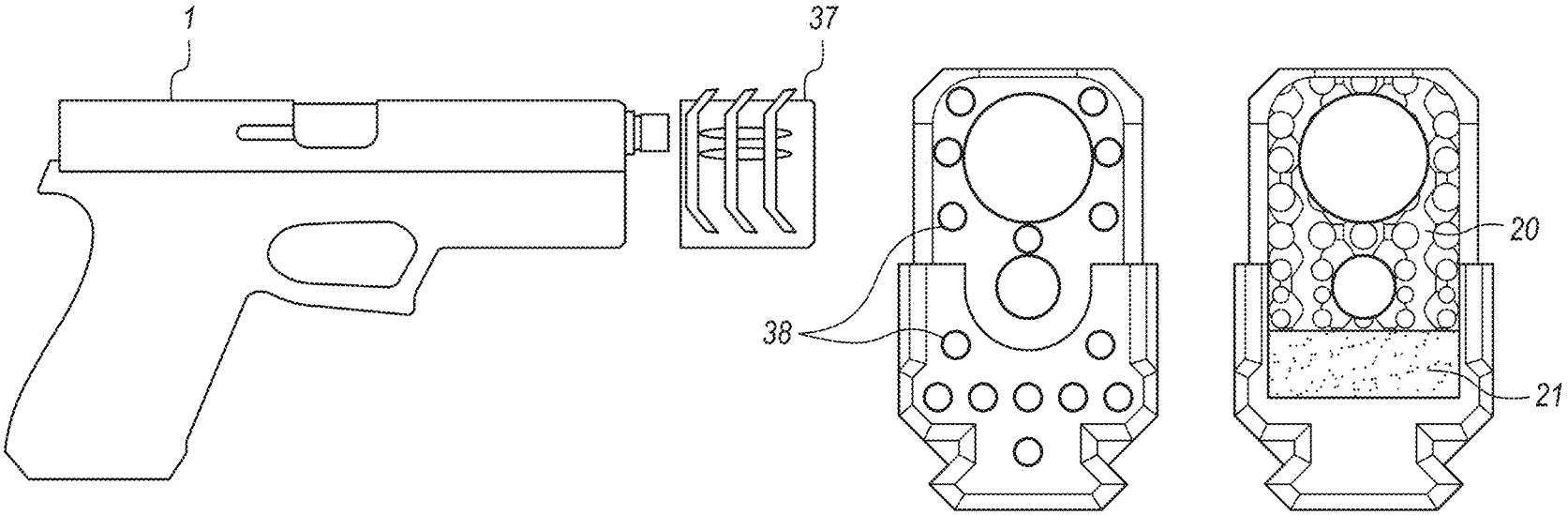
FIG. 12 is a depiction of an alternate form factor showing that this device is not limited to a cylindrical cross-section and demonstrates that the device can be shaped to duplicate the geometry of any firearm.

FIG. 12 contains both a side view of a typical handgun 1 along with a conformable shaped filter 37 as an alternative to a cylindrical shaped filter. The filter membrane materials 20, 21 used in this device 7, allow for different physical form factors. The membrane materials 20, 21 can be easily machined or molded with non-traditional shapes. FIG. 12 represents an embodiment that matches the physical dimensions of the end of the barrel on handguns 1. The end view depicts what the profile of this device 7 can be shaped like. It can be attached using various techniques that will be detailed in the drawings contained herein.

The front view of a conformable shaped filter depicts the configuration of using both the refractory foam 20 and the organic filter 21. These act in a similar fashion to the cylindrical configuration detailed earlier. The exhaust vent holes 38 are in a random configuration to allow for maximum air movement and filter engagement. One of the key attributes of having a conformable shape for a handgun 1, is the ability to holster the weapon. Virtually every handgun suppressor on the market today is round in its cross-sectional shape and adds significant length to the handgun making holstering the handgun with a typical suppressor virtually impossible. By having the same geometry as the muzzle portion of the handgun, it will not interfere with the holstering and drawing of the weapon. This is a very important feature especially for law enforcement and their ability to train with this device 7.

Figure 13:
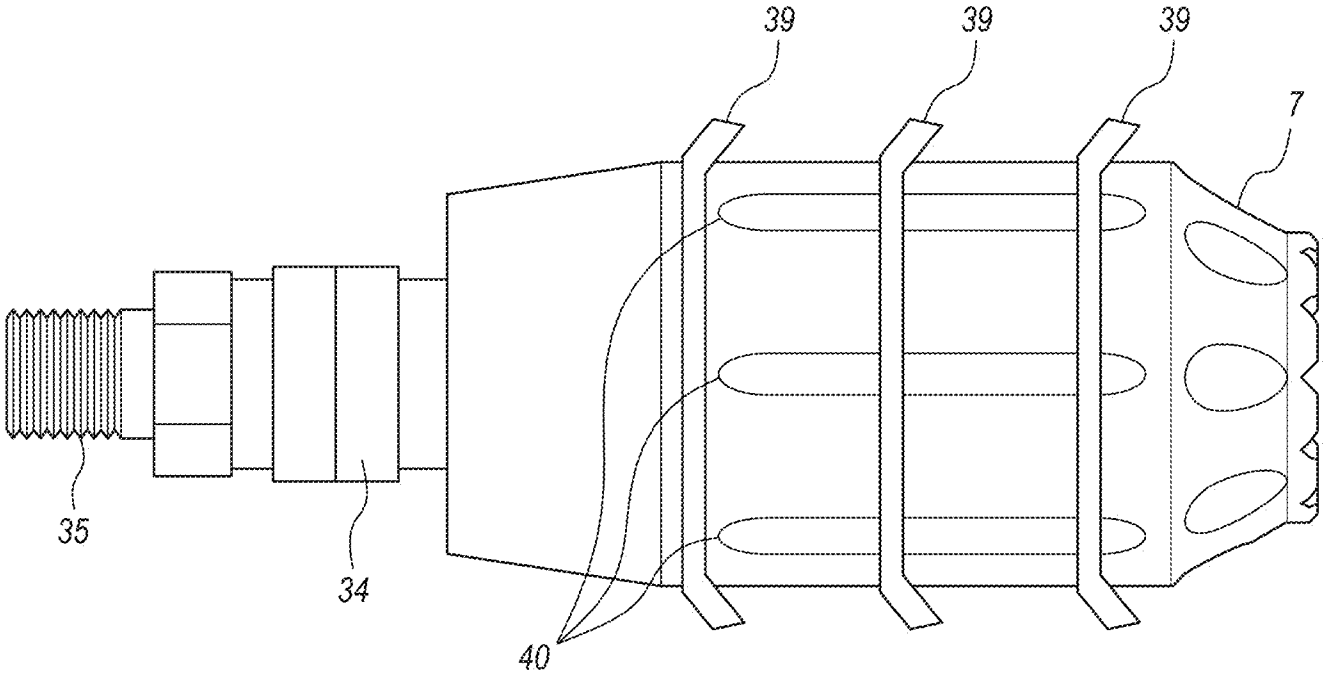
FIG. 13 is a side view of the device showing the outer vent paths for the filtered air to escape demonstrating that the vent paths are designed to force the exhaust air forward and away from the shooter.

FIG. 13 is a side view of the exterior geometry of the device 7. The exterior shape and look of the device 7 can vary based on many factors. Some of the design features will transcend alternative embodiments. The device 7 will have a series of multiple forward facing deflectors 39. These deflectors 39 will force the exhaust gases forward and away from the shooter 1, 2 (not shown). The deflectors 39 are located around the entire circumference of the device 7 and can vary in height and width.

The device 7 also contains a series of vents 40 that run longitudinally down the bore axis of the device 7. The longitudinal vents 40 can vary in width and length depending on the final external geometry of the deice 7. The vents 40 allow the filtered exhaust gases 3 (not shown) to exit the device in a uniform and predictable pattern. The relationship between the size, height, and shape of the forward-facing deflector vents 39 and the longitudinal vents 40 is a function of the burst pressure associated with the discharge of the firearm and the amount of the discharge gases expelled.

Figure 14:
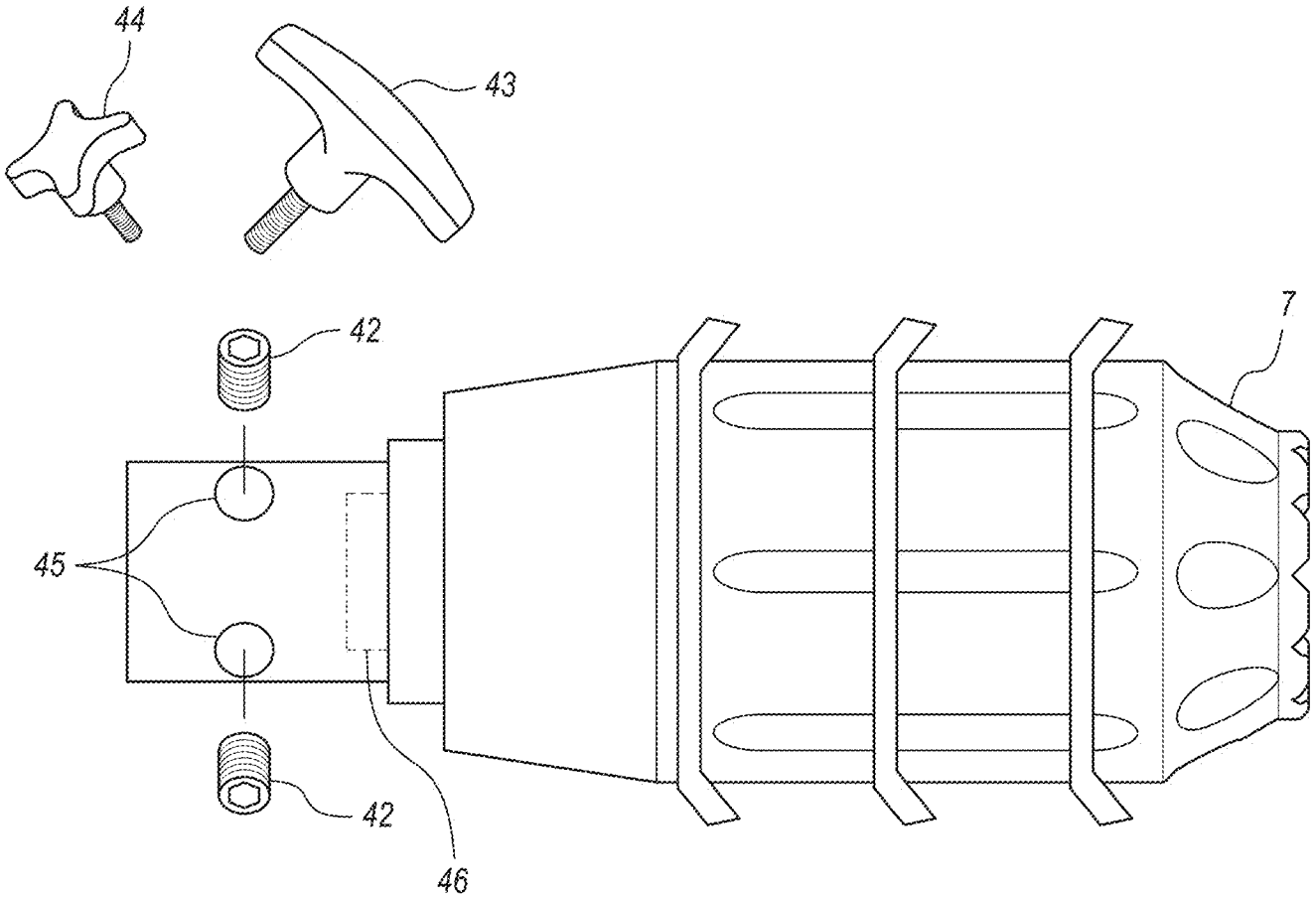
FIG. 14 is a side view showing an attachment technique that utilizes various set screw attachments to fasten the device to the muzzle end of the firearm.

FIG. 14 is a side view of the external geometry of the device 7. This drawing depicts one of several ways that the device 7 can be attached to a firearm. In this configuration, the device 7 slides over the end of the barrel and attaches using a set screw 42 approach with at least three evenly spaced circumferential holes 45 to ensure an even attachment. The set screws 42 would ideally locate into a machined groove that is located at the end of the barrel to eliminate any possibility of the device 7 loosening and separating during a discharge. In addition to a set screw 42 to fasten the device 7 to the barrel, this configuration also contains a conformable gas seal gasket 46 located on the internal sleeve of the muzzle end of the device 7. This gasket 46 will seal off all the hot exhaust gases between the barrel and the device 7 forcing all the exhaust gases 3 (not shown) into the filter mechanism. The set screws 42 can be tightened by various tools including a "T" handle 43, or a cloverleaf style knob 44 for the case of assembly and removal of the device 7.

Figure 15:
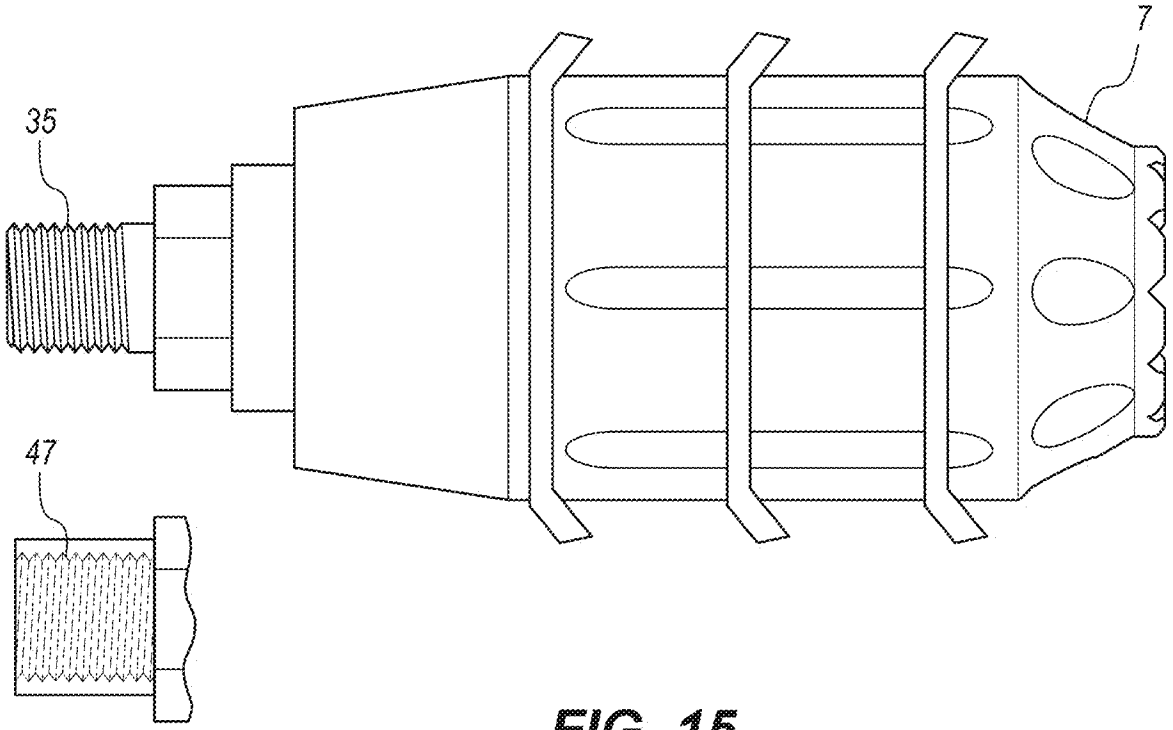
FIG. 15 is a side view showing an attachment technique that utilizes either a threaded male end or threaded female end of the device to attach to the firearm.

FIG. 15 is a side view of the external geometry of the device 7. This configuration depicts a threaded male attachment 35 technique which allows the device 7 to be threaded into a barrel that has threads machined into the barrel end. The preferred embodiment either threads into the ID of the barrel end or if the barrel has machined male threads on the end of the barrel, the device 7 would have a matching set of threads 47 machined on the inside of the device 7 located at the attachment end of the device 7. It is anticipated that a threaded barrel attachment technique is the most efficient and robust attachment technique for this device 7.

Figure 16:
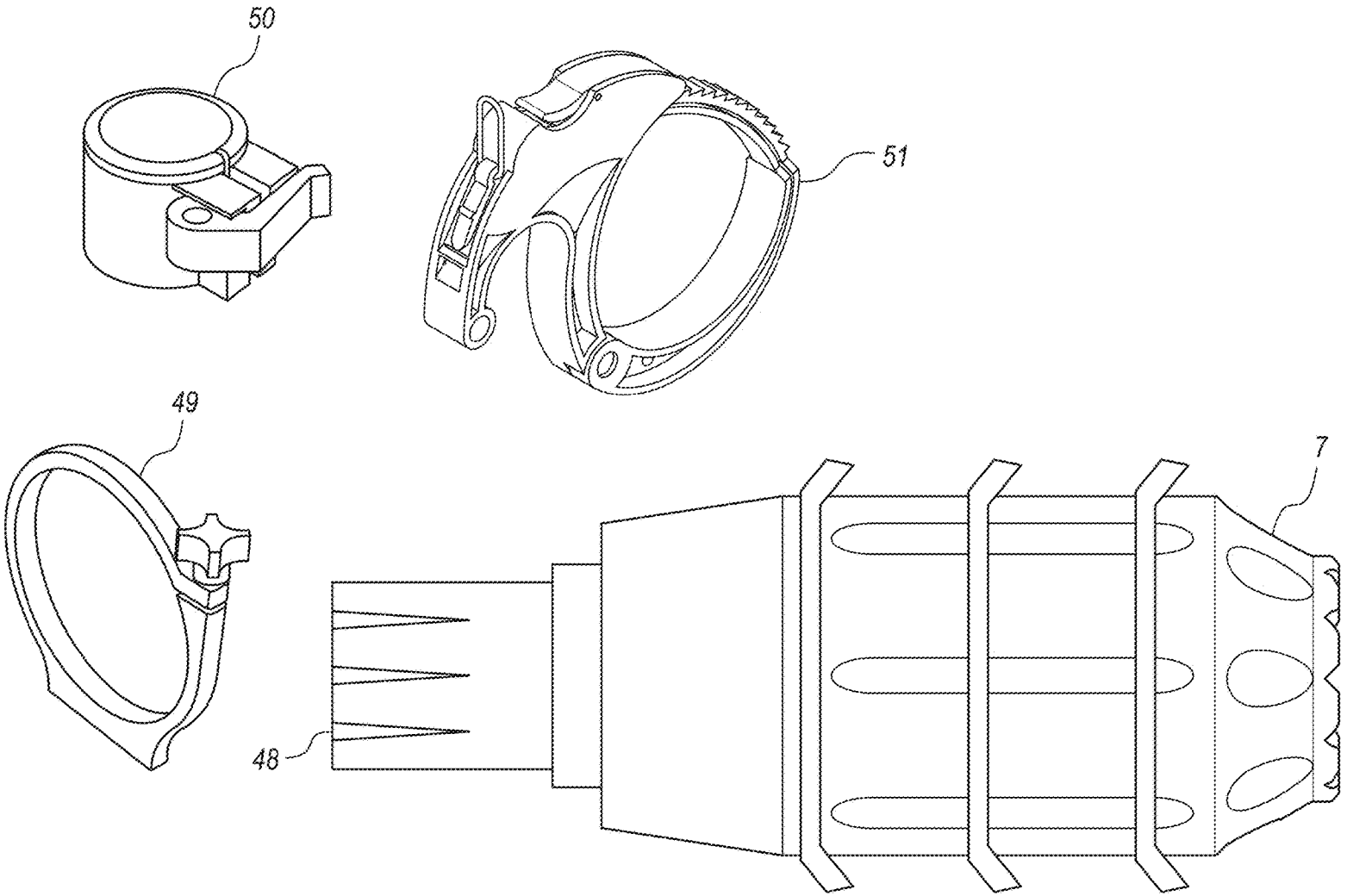
FIG. 16 is a side view of the device showing an attachment technique that utilizes a non-permanent form of attachment to a firearm. These types of clamps include bayonet style and cam lock mechanisms to attach to the muzzle end of the firearm.

FIG. 16 is a side view of the external geometry of the device 7. This configuration demonstrates a slip fit attachment technique that contains a series of relief notches 48 in the housing sleeve that slips over the end of the firearm barrel. The material removed by this slotting allows the steel tube attachment section in the device 7 to conform to a variety of barrel diameters. Once the device 7 is slipped over the end of the barrel, it is clamped down to the barrel using a variety of potential clamping techniques. These images represent different styles of clamping approaches 49, 50, 51 to compress the device 7 down onto the barrel to achieve a tight seal to the firearm barrel. It is also anticipated that this clamping technique would be used in conjunction with using an internal gasket 46 for additional sealing the barrel to the device 7.

Figure 17:
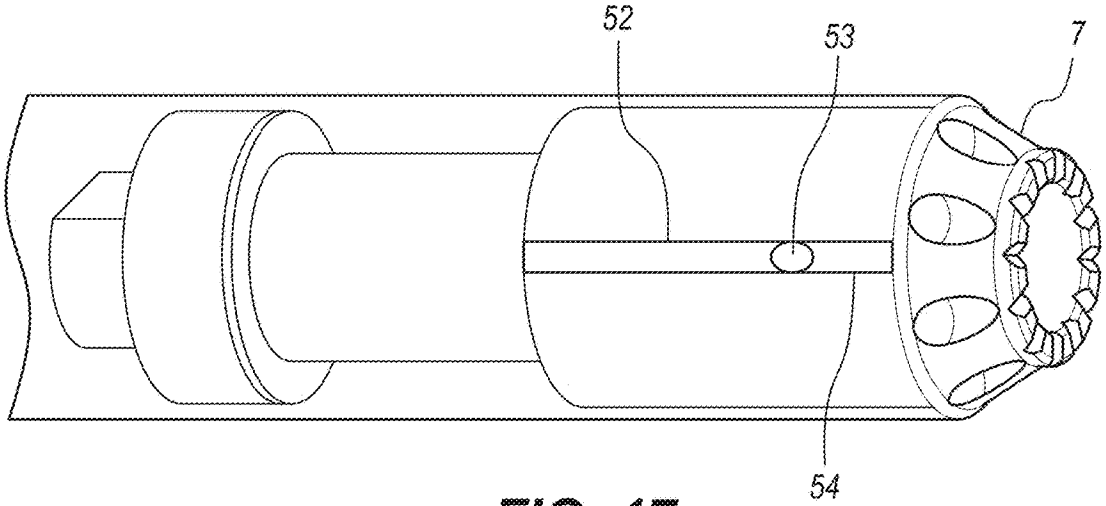
FIG. 17 is a side view of the device that depicts a mechanism that is a mechanical shot counter so that the shooter will know when the filter is saturated and has to be changed.

FIG. 17 is an isometric view of the device 7 with the filter membrane removed. This device has a passive and/or an active method for monitoring the saturation level of the filter membranes 20, 21 (not shown). In this configuration, the device has a slot 54 located in the external housing of the device 7. The slot is connected to the hot exhaust air path 52 within the device 7. Located within the slot track 54, is a ball bearing 53 that slides within the slot track 54. When the device 7 is new, the ball bearing 53 is at the beginning of the slot 54. As the weapon is discharged, the ball bearing 53 moves slightly down the slot track 54 on every shot. The number of shots and the indexed movement of the ball 53 is calibrated based upon the type of ammunition fired. Based upon testing of various ammunition calibers and grain amounts for different cartridges, the number of shots can be determined to achieve full filter 20, 21 saturation levels. Based upon the device 7 configuration and size, the number of shots fired until the filter membranes 20, 21 reach saturation will vary. With each discharge of the weapon, the ball bearing 53 can only move forward a given distance for each firing. When the ball bearing 53 reaches the end of the slot track 54 the filter is saturated and ready to be replaced.

Figure 18:
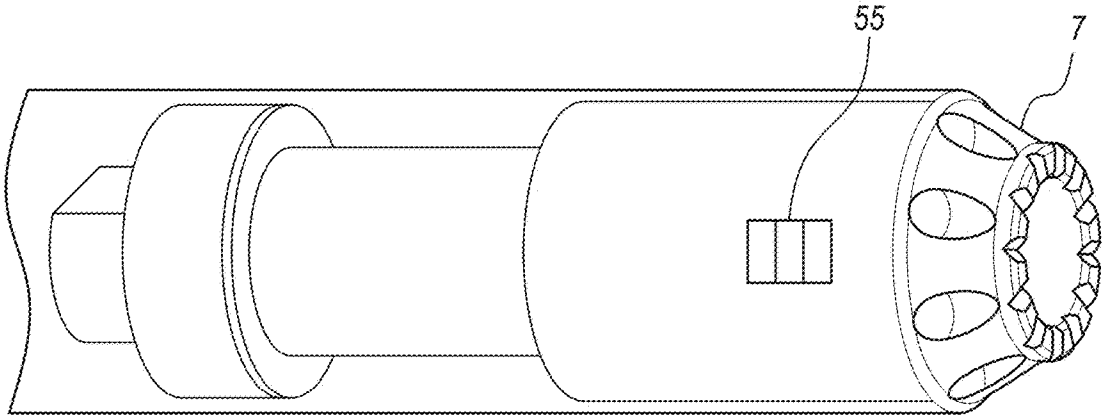
FIG. 18 is a side view depicting an active method for identifying when the filter membranes have reached a maximum saturation level.

FIG. 18 is an isometric view of the device 7 with the filter membranes removed. This device 7 has an active method of monitoring the status of the filter membranes. The active method may utilize sound and/or vibration caused by a firearm discharge. The process of the active method of determining filter status is detailed on FIG. 19. The status of the filter membranes can be seen using an LED light 55 source located on the exterior of the device 7. This LED light 55 will light activate once the filter membranes are fully saturated. Again, using the method of analyzing the number of firings required to saturate the filter membranes, the number of discharges will vary based upon ammo type and gun type.

Figure 19:
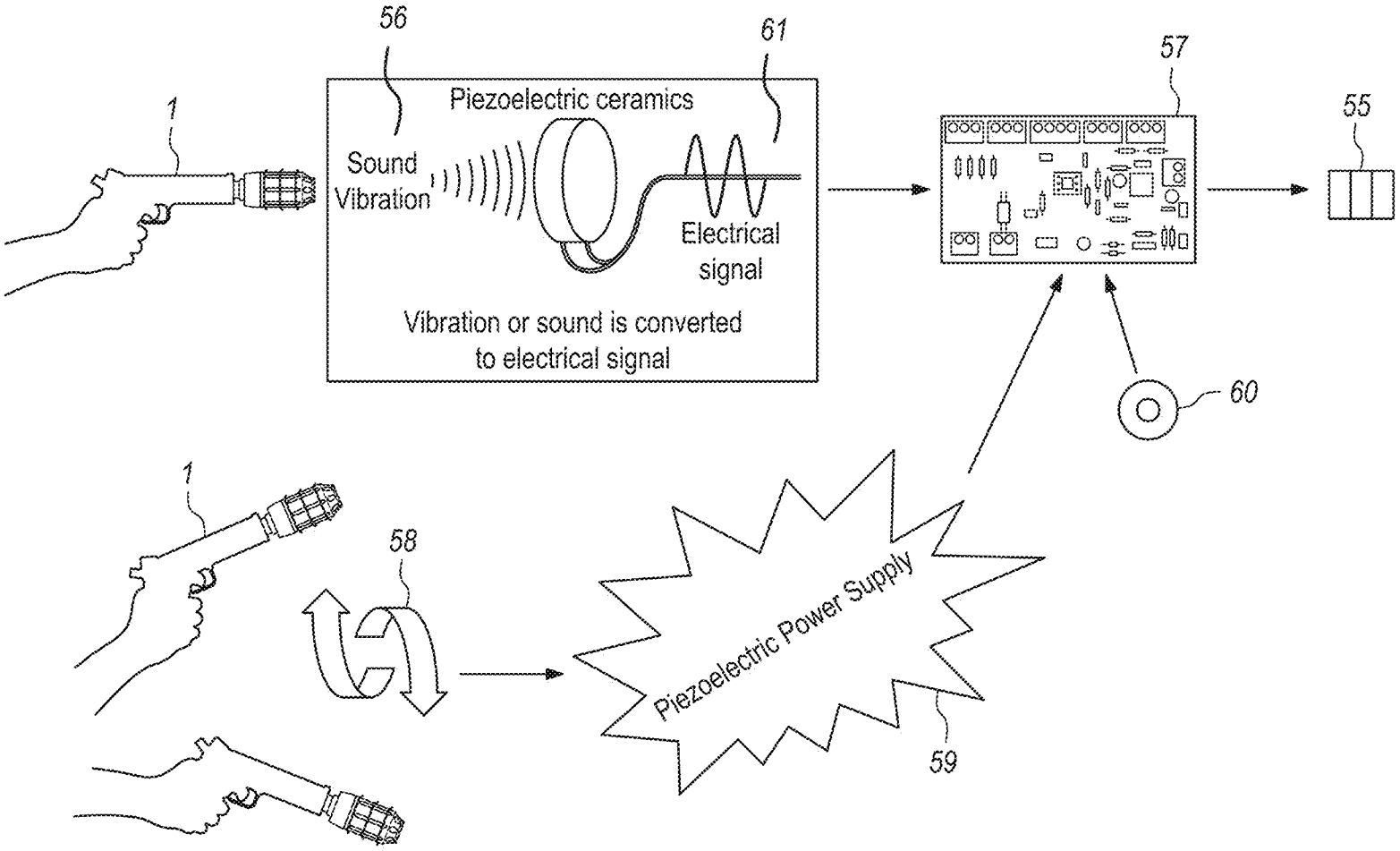
FIG. 19 is a diagram showing the conversion of sound and vibration to a piezoelectric mechanism to provide an electric signal on every shot fired.

FIG. 19 is a graphical representation of the process in which the shot counter and subsequent filter membranes level of saturation is defined for the active method described in FIG. 18. Both battery and non-battery power sources provide power to an electronic shot counter within the device. The number of firings are tracked and equated to a specific level of membrane saturation. When the filter is saturated the device will flash a mini-LED light notifying the operator that the filter needs to be changed. This counter also has other utility as well and can be used for warranty, weapon use history, operator exposure, etc. The process begins by using the sound and vibration 56 caused by the discharge of the firearm to activate a piezoelectric ceramic device which is then converted to an electrical signal 61. The electrical signal 61 acts as a shot counter and sends an electrical signal 61 to a circuit board 57. Located on that circuit board 57 is a small ultra-capacitor, memory chip, etc., which will store the historical shot data for the device 7 and send a status level signal to the LED light indicator 55 located on the outside of the device 7. The light 55 itself will show at least three levels of filter saturation that can easily be seen by the shooter or range supervisor.

There are two different methods of supplying power to this active system. The first being a piezoelectric electric power device 59 that generates power based on the physical movement 58 of the device 7. The discharge activates a piezoelectric ceramic mechanism that converts sound and/or vibration forces into an electric signal wherein the electric signal is then sent to a circuit board where it is tallied as a shot counter and can be relayed to other devices via RFI. Another option for power generation is to simply use a disc style battery 60. The power requirements for the active system are very small and do not require a significant amount of electrical power.

In a preferred embodiment, provided is a firearm filtration device that collects hazardous materials expelled by the discharge of a weapon system such as small arms, heavy weapons, and larger platform indirect and direct systems. Said weapon system may include a barrel that is either rifled or smooth bore on the internal diameter of the barrel. Said barrel terminates at the muzzle which expels a plurality of projectiles in addition to hot exhaust gases which include a wide array of hazardous materials. This device, in its various configuration, attaches or may be integrated into the muzzle end of any weapon system for the primary use of trapping and containing the hazardous components and gases expelled.

In another preferred embodiment, the system is comprised of a housing containing a filter membrane having a generally cylindrical bore through the center. The filter member may be comprised of, for example, reticulated refractory foam, that can be embedded with ceramics, thermoplastics, sand, polymers, hydrogels, naturally occurring substances, recycled goods, organics, inorganics, and/or synthetics. Said housing is attached as an extension of said muzzle which is aligned to the axial direction of the bore. Said housing receives hot gases which are then cooled and expelled through both the axial and radial surfaces of said device.

In a further preferred embodiment, provided is a filter having a refractory foam cell size that is larger in size at the end adjacent to the attachment point to the muzzle and is smaller in size toward the end of the filter that is adjacent to the exit point of the device. This allows for a gradual increase in back pressure to the weapon. As the smaller cells begin to trap the heavy metal particles like lead, the filter membrane begins to saturate, and the back pressure will increase as the filter begins to saturate.

In another preferred embodiment, the filter is comprised of the material such as metallic refractory foam. The cell size and metallic substrate can vary based on a number of factors. In general, the foam composition should have a temperature threshold exceeding 800 degree F. with hole sizes ranging from 20 microns up to a tenth of an inch in diameter. The filter may be coated with specific control substrates, such as sodium carbonate and potassium carbonate to specifically target and sequester or interact with both organic and inorganic compounds. The filter may further include activated charcoal, hydrogels, and/or a rolled membrane consisting of a metal wire mesh.

In still another preferred embodiment, the porosity of the filter may vary to form:

(a) Pressure gradients;
(b) Clockwise helical gradients;
(c) Counterclockwise helical gradient to counteract and stabilize the housing; and
(d) Dense porosity spacers to create one or more compartments to control gas flow from one or more compartments.

In a preferred embodiment, provided is a firearm filtration device having a filter or filter membrane that is a standalone filter. In an alternative embodiment the filter or filter membrane may be removable, replaceable, recyclable and/or refurbished.

In yet another preferred embodiment, provided is a housing for a firearm filtration device wherein the housing may be attached to a firearm utilizing at least one of a variety of attachment techniques such as:

(a) a clamping mechanism that utilizes a plurality of set screws that are fastened to the outer surface of the firearm barrel. These set screws must have a minimum of three screws and can be fastened using a typical Allen style wrench, or hand fasteners similar to a "T' Handle.
(b) a clamping mechanism that utilizes a cam lock style compression clamp, with a relieved section of the muzzle end filter housing.
(c) a clamping mechanism using a standard bayonet style twist locking mechanism that engages the firearm barrel end to the housing of claim 1.
(d) a clamping mechanism that utilizes a slide on picatinny style rail.
(e) Threaded male end located on the firearm barrel muzzle that threads into corresponding female threads that are machined into the ID of the device located at the muzzle end of the device.
(f) Threaded female end located on the ID of the firearm barrel end that the Device threads into. The muzzle end of the device in this scenario has male threads.
(e) Quick disconnect mechanism that connects the muzzle end of the firearm barrel to the device utilizing quick disconnect coupling that not only provides as the attachment connection, but an airtight seal between the firearm and the device.

In another preferred embodiment, provided is a saturation indicator system for a firearm filtration device, wherein there is an active method or a passive method of determining the saturation level of filter membranes contained within a housing. The active method utilizes sound and/or vibration caused by a firearm discharge, wherein the discharge activates a piezoelectric ceramic mechanism that converts sound and/or vibration forces into an electric signal wherein the electric signal is then sent to a circuit board where it is tallied as a shot counter and can be relayed to other devices via RFI. The electrical power source for the active method of identifying that status of the filter membrane, is generated by a piezoelectric motor located within the housing. This motor generates electrical power by moving the weapon or the device itself in a back-and-forth physical motion. The electrical power source for the active method is generated by a disc style battery within the housing. The active method further utilizes an audible warning that the filter has reached its saturation limit wherein the vibrational and sound inputs are captured using a microphone and/or a potentiometer. The circuit board contains a memory chip that tracks other data apart from the filter membrane saturation status. This data can include data like; cyclic rate of fire for the weapon while the device is attached to the weapon, date and time stamps, etc.

In another preferred embodiment, provided is a passive method of determining the saturation level of the filter membranes contained within the housing. The passive method utilizes a ball bearing located within a slot channel that moves in a linear fashion after each discharge of the firearm is conducted. Each discharge of the firearm moves the ball bearing one increment. The status level of filter saturation can be visibly observed on the perimeter of the housing itself by using simple widely recognized color range which begins at a green color when the filter is new verses a red color when the filter has reached its maximum level of saturation. There is a correlation of each discharge of the firearm to the amount of contaminants that the filter membrane can trap wherein the filter membrane saturation level is calculated based upon the weapon type, caliber, and grain load for each weapon platform. When the filter mechanism reaches a state of maximum saturation, the back pressure will increase to a point, that if the back pressure begins to approach a critical barrel burst strength threshold, primary pressure indicator will reveal followed by a secondary pressure indicator will cause the front end of the housing to separate thus eliminating the possibility of causing a firearm barrel failure.

In yet another embodiment, as referenced in FIGS. 1) and 2) of the submittal, a process related to the weapon filter device whereby the device is part of a holistic approach to not just capture the hazardous materials that are exhausted from a discharge event, but one in which the contaminated filter housing is removed from the weapon and placed into a hazardous material receptacle minimizing any human contact. Once the receptacle is full it is removed from the range and brought to an authorized recycling center for Lead and other hazardous materials. Depending on which version is recycled, the used devices will go to either a landfill, be recycled, be refurbished, or the filters are removed, and new filters are replaced. In the case of refurbishment, said filter devices are rinsed and cleaned through a least one solvent tank to remove hazardous contaminants from the device.

In still another embodiment, provided is a process for mitigating hazardous materials expelled from a weapon system, wherein the process is comprised of the following steps:

a) attaching a firearm filtration device to a barrel of a weapon wherein the firearm filtration device is comprised of:
   an inner membrane housing;
   at least one core housing, wherein the at least one core housing contains at least one filter membrane;
   at least one baffle;
   a housing having at least one deflector; and
   at least one vent, wherein the at least one vent controls the exit direction of discharged gases and byproducts from the firearm;
b) monitoring a saturation level of the at least one filter, wherein the saturation level increases as a function of weapon discharge;
c) determining that the saturation level of the at least one filter has reached a maximum level;
d) removing the firearm filtration device from the barrel of the weapon; and
e) disposing of the filter membrane in a special hazardous material receptacle.

All of the features disclosed in this claim may be combined in any combination. Each feature disclosed in this claim may be replaced by an alternative feature serving the same, equivalent, or similar purpose. Thus, unless expressly stated otherwise, each feature disclosed is only an example of a generic series of equivalent or similar features. As used in this claim and in the appended claims, the singular forms include the plural forms. For example, the terms "a," "an," and "the" include plural references unless the content clearly dictates otherwise. Additionally, the term "at least" preceding a series of elements is to be understood as referring to every element in the series. The inventions illustratively described herein can suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the future shown and described or any portion thereof, and it is recognized that various modifications are possible within the scope of the invention claimed. Thus, it should be understood that although the present invention has been specifically disclosed by preferred embodiments and optional features, modification and variation of the inventions herein disclosed can be resorted by those skilled in the art, and that such modifications and variations are considered to be within the scope of the inventions disclosed herein. The inventions have been described broadly and generically herein. Each of the narrower species and subgeneric groupings falling within the scope of the generic disclosure also form part of these inventions. This includes the generic description of each invention with a proviso or negative limitation removing any subject matter from the genus, regardless of whether or not the excised materials specifically resided therein. In addition, where features or aspects of an invention are described in terms of the Markush group, those schooled in the art will recognize that the invention is also thereby described in terms of any individual member or subgroup of members of the Markush group. It is also to be understood that the above description is intended to be illustrative and not restrictive. Many embodiments will be apparent to those of in the art upon reviewing the above description. The scope of the invention should, therefore, be determined not with reference to the above description, but should instead be determined with reference to the appended Claims, along with the full scope of equivalents to which such Claims are entitled. Those skilled in the art will recognize or will be able to ascertain using no more than routine experimentation, many equivalents to the specific embodiments of the invention described. Such equivalents are intended to be encompassed by the following Claims.

What is claimed is:

1. A firearm filtration device that attaches to, and collects hazardous materials expelled by discharge of, a firearm, the device comprising:
(a) an inner membrane housing;
(b) at least one core housing, wherein the at least one core housing contains at least one filter, wherein the at least one filter has a member section with a plurality of holes, wherein the plurality of holes has a reducing size in diameter along a length of the housing towards a exit point of the device;
(c) at least one baffle;
(d) a housing having at least one deflector; and
(e) at least one vent, wherein the at least one vent controls an exit direction of discharged gases and byproducts from the firearm.

2. The filtration device of claim 1, wherein the at least one filter is a standalone filter.

3. The filtration device of claim 1, wherein the at least one filter is removable.

4. The filtration device of claim 1, wherein the at least one filter is replaceable.

5. The filtration device of claim 1, wherein the at least one filter is recyclable.

6. The filtration device of claim 1, wherein the at least one filter may be refurbished.

7. The filtration device of claim 1, wherein the at least one filter captures discharged material, gases, nanosized materials, metallics and solvents by at least one single stage filtration member for specific discharged materials.

8. The filtration device of claim 1, wherein the at least one filter captures discharged material, gases, nanosized materials, metallics and solvents by at least one multi-stage filtration member for different discharged materials.

9. The filtration device of claim 1, wherein the at least one filter suppresses visible flashes while capturing discharged materials.

10. The filtration device of claim 1, wherein the core housing reduces deflected pressure waves by venting materials rearward towards the at least one filter to capture the discharged materials.

11. The filtration device of claim 1, wherein the core housing suppresses impulse noise and overpressure while the at least one filter captures the discharged materials.

* * * * *